US007944419B2

(12) United States Patent
Kim

(10) Patent No.: US 7,944,419 B2
(45) Date of Patent: May 17, 2011

(54) FLAT PANEL DISPLAY HAVING PRE-CHARGING CIRCUIT

(75) Inventor: Ji Hun Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1136 days.

(21) Appl. No.: 11/702,565

(22) Filed: Feb. 6, 2007

(65) Prior Publication Data

US 2008/0007551 A1 Jan. 10, 2008

(30) Foreign Application Priority Data

Jul. 6, 2006 (KR) ..... 10-2006-0063653

(51) Int. Cl.
*G09G 3/32* (2006.01)

(52) U.S. Cl. ..... 345/82; 345/214

(58) Field of Classification Search ..... 345/82, 345/214

See application file for complete search history.

(56) References Cited

U.S. PATENT DOCUMENTS 5,170,072 A * 12/1992 Ihara ..... 327/306
6,266,039 B1 * 7/2001 Aoki ..... 345/94
6,529,180 B1 * 3/2003 Ito et al. ..... 345/89
6,756,957 B2 * 6/2004 Park ..... 345/92
6,914,587 B2 7/2005 Kosaka
2004/0227749 A1 11/2004 Kimura
2005/0264499 A1 * 12/2005 Kim et al. ..... 345/76
2006/0125744 A1 * 6/2006 Klein et al. ..... 345/82

FOREIGN PATENT DOCUMENTS

CN 100380429 C 4/2008
EP 1 566 793 A1 8/2005

* cited by examiner

*Primary Examiner* — Richard Hjerpe
*Assistant Examiner* — Andrew Schnirel
(74) *Attorney, Agent, or Firm* — Morgan, Lewis & Bockius LLP

(57) ABSTRACT

Provided is a flat panel display and a method for driving the same. The flat panel display comprises a substrate, a pixel part having a plurality of sub-pixels formed on the substrate; and a data driver supplying to the pixel part data signals and charge signals containing charge values that correspond to the data signals. Each charge signal comprises a first charge signal and a second charge signal, and the first charge signal is a voltage signal selected from a plurality of preset voltage levels. The second charge signal is a current signal corresponding to the difference between the voltage value corresponding to the first charge signal and the charge value that corresponds to the data signal.

4 Claims, 7 Drawing Sheets

FLAT PANEL DISPLAY HAVING PRE-CHARGING CIRCUIT

CROSS-REFERENCE

This application claims priority to and the benefit of Korea Patent Application No. 10-2006-0063653, filed on Jul. 6, 2006, the entire content of which is incorporated herein by reference.

BACKGROUND

1. Field

The present invention relates to a flat panel display and a method for driving the same.

2. Related Art

Among various flat panel display devices, a light emitting display device is generally advantageous of a fast response rate and low power consumption. Since a light emitting display device does not need a backlight, it can be manufactured lightweight.

In particular, an organic light emitting display device comprises an organic emission layer formed between an anode and a cathode. Thus, holes supplied from an anode and electrons supplied from a cathode are connected together within the organic emission layer to produce excitons, which are electron-hole pairs. When these excitons transit to a ground state, a certain level of energy is produced, and this energy causes the organic light emitting display device to emit light.

A flat panel display represents an image by applying data signals within a duration that scan signals are applied. However, since each sub-pixel has a parasitic capacitance, it is hard to represent gray scales exactly when the data signals are inputted. For this reason, a pre-charge signal is supplied to preliminarily charge sub-pixels and, after data signals are applied, a discharge signal is supplied to a pixel part to discharge the sub-pixels.

According to conventional technology, however, pre-charge signals are applied indiscriminately. Thus, an actually needed pre-charge signal is not applied to the pixel part. Also, since a discharge signal is applied with no regard to the data signals to be applied in the next frame, the pixel part is indiscriminately discharged by the discharge signal to a predetermined level. This results in wasteful consumption of power by the unnecessary supply of a pre-charge or discharge signal.

SUMMARY

An embodiment of the present invention provides a flat panel display that can exactly represent a desired image with reduced power consumption, and a driving method thereof.

According to an aspect of the present invention, provided is a flat panel display comprising a substrate, a pixel part having a plurality of sub-pixels formed on the substrate, and a data driver supplying to the pixel part data signals and charge signals containing charge values that correspond to the data signals. Each charge signal includes a first charge signal and a second charge signal, and the first charge signal is a voltage signal selected from a plurality of preset voltage levels. Herein, the second charge signal is a current signal corresponding to the difference between the voltage value corresponding to the first charge signal and the charge value that corresponds to the data signal.

According to another aspect of the present invention, provided is a method for driving the flat panel comprising supplying a scan signals to a pixel part which comprising a plurality of sub-pixels, supplying a data signals and charge signals comprising a charge value corresponding to the data signals to the pixel part selectively. Herein, the charge signals comprises a first charge signal and a second charge signal, and the first charge signal being a voltage signal selected from a plurality of preset voltage levels. The second charge signal is a current signal corresponding to the difference between the first charge signal and the charge value.

BRIEF DESCRIPTION OF THE DRAWINGS

The invention will be described in detail with reference to the following drawings, in which like numerals refer to like elements.

DESCRIPTION OF EMBODIMENTS

Figure 1:
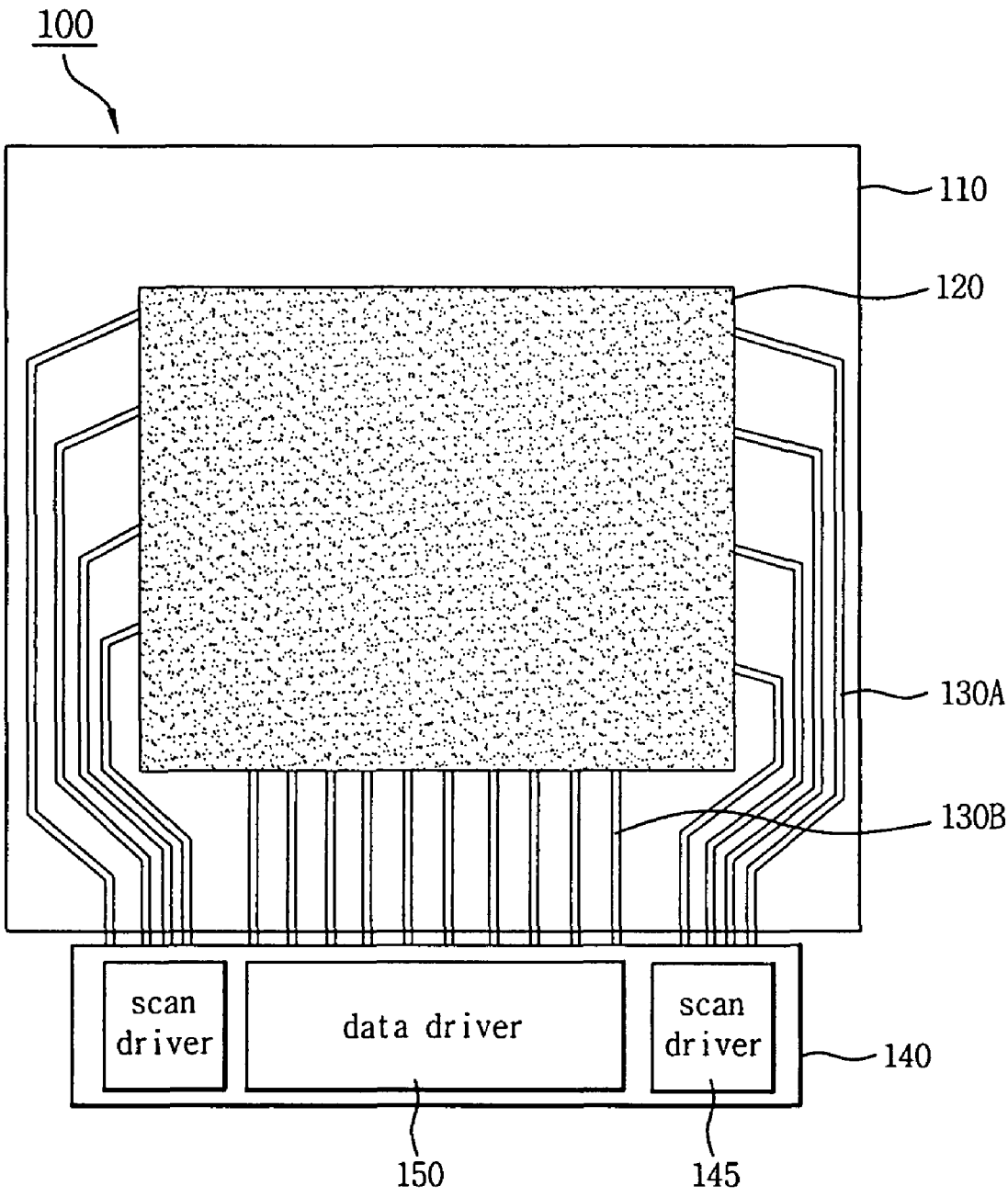
FIG. 1 is a plane view showing a flat panel display according to an embodiment of the present invention.

Referring to FIG. 1, a flat panel display 100 suggested in a first embodiment/of the present invention comprises a pixel part 120 and a driving part 140 disposed on a substrate 110.

The pixel part 120 comprises a plurality of sub-pixels, each comprising an anode, a cathode, and an organic light emission layer interposed between the two electrodes. Although not shown, the sub-pixels are positioned in areas defined by intersection of scan lines and data lines. Each sub-pixel may comprise at least one transistor and capacitor connected to the anode.

The driving part 140 comprises a scan driver 145 and a data driver 150, and it supplies a driving signal to the pixel part 120 through scan lines 130A and data lines 130B upon receipt of a control signal from a controller (not shown). The driving part 140 comprises a scan driver 145 and a data driver 150 therein for the sake of convenience in description. However, the scan driver 145 and the data driver 150 may be realized in independent forms or they may be realized in multiple units, individually.

Figure 2:
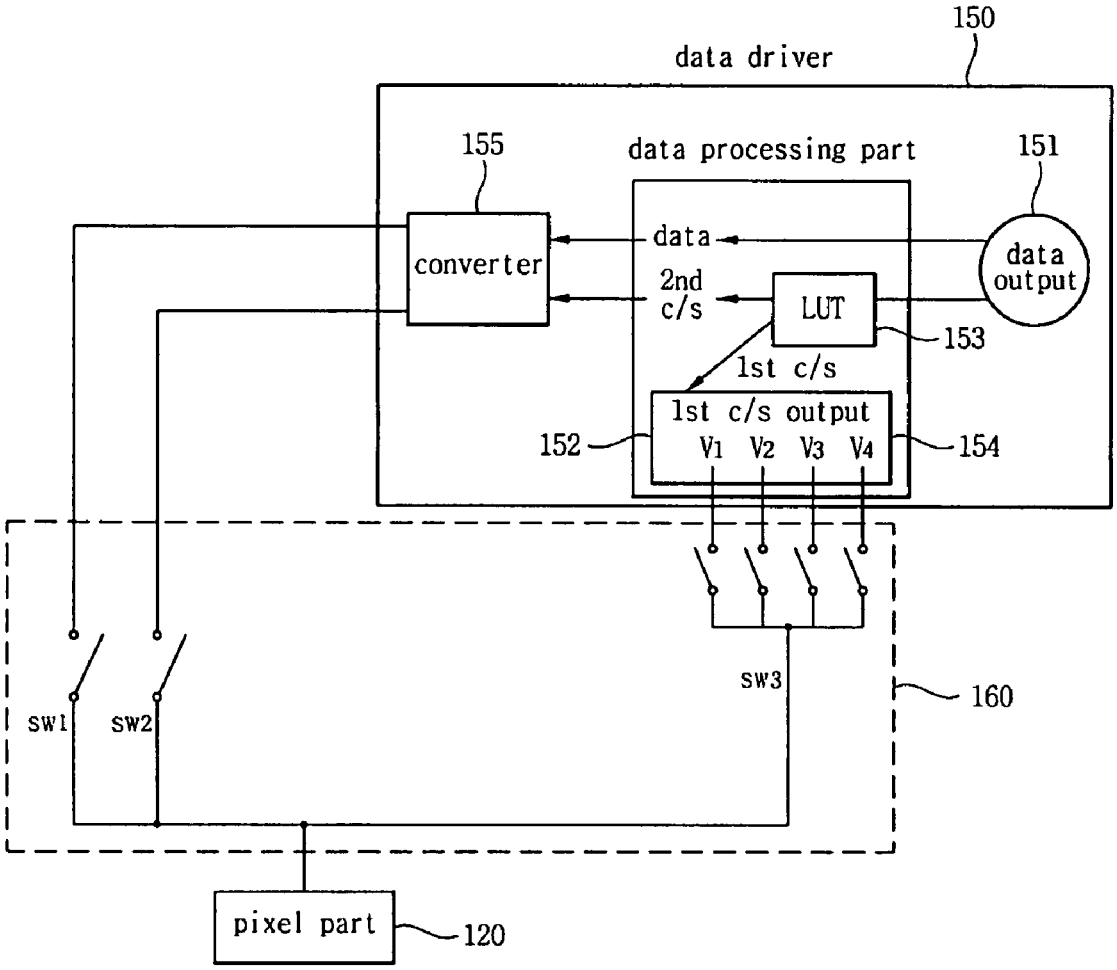
FIG. 2 is a block view illustrating a data driver of the flat panel display according to the embodiment of the present invention.

FIG. 2 is a block view illustrating a data driver of a flat panel display according to an embodiment of the present invention.

Referring to FIG. 2, the data driver 150 comprises a data output part 151, a data processing part 152, and a converter 155.

The data output part 151 receives digital data signals from the outside to the data processing part 152. Herein, the data signals are values corresponding to gray scales to be represented in the pixel part 120.

The data processing part 152 processes the data signals transmitted from the data output part 151 and generate charge signals corresponding thereto. The charge signals are for exactly representing gray scales based on the data signals by satisfying a parasitic capacitance of the pixel part or for discharging charges charged in sub-pixels by data signals supplied in the previous frame. The charge signals comprise a first charge signal and a second charge signal.

The charge signals may be applied before data signals are applied to the pixel part (P). Pre-charge signals may be acquired by processing the data signals and calculating the optimal values.

Herein, the data processing part 152 may comprise a lookup table 153 and a first charge output part 154. The lookup table 153 stores ideal charge values for data signals, and the first charge output part 154 comprises a plurality of preset voltage values. The data processing part 152 receives the data signals, determines an ideal charge value for the data signals based on the lookup table 153, selects a voltage value which is smaller than the ideal voltage value and close to the ideal voltage value, and outputs a first charge signal. It also generates a second charge signal corresponding to the difference between the ideal charge value and the first charge signal.

The converter 155 converts the data signals transmitted from the data processing part 152 or the second charge signal into current. In short, it converts digital signals into analog signals.

The driving part 140 may further comprise a switch part 160. The switch part 160 is connected to a controller (not shown) and the data driver 150 and optionally supplies the data signals, the first charge signal, and the second charge signal to the pixel part 120. The switch part 160 comprises a first switch SW1 and a second switch SW2 between the converter 155 and the pixel part 120. The data signals may be supplied to the pixel part 120 through the first switch SW1, whereas the second charge signal may be supplied to the pixel part 120 through the second switch SW2. Herein, the second switch SW2 may further comprise a booster to thereby supply the second charge signal after boosting.

The switch part 160 may comprise a third switch SW3 interposed between the first charge output part 154 and the pixel part 120. The third switch SW3 may comprise a plurality of switches connected to a plurality of voltage values determined in the first charge output part 154.

Figure 3:
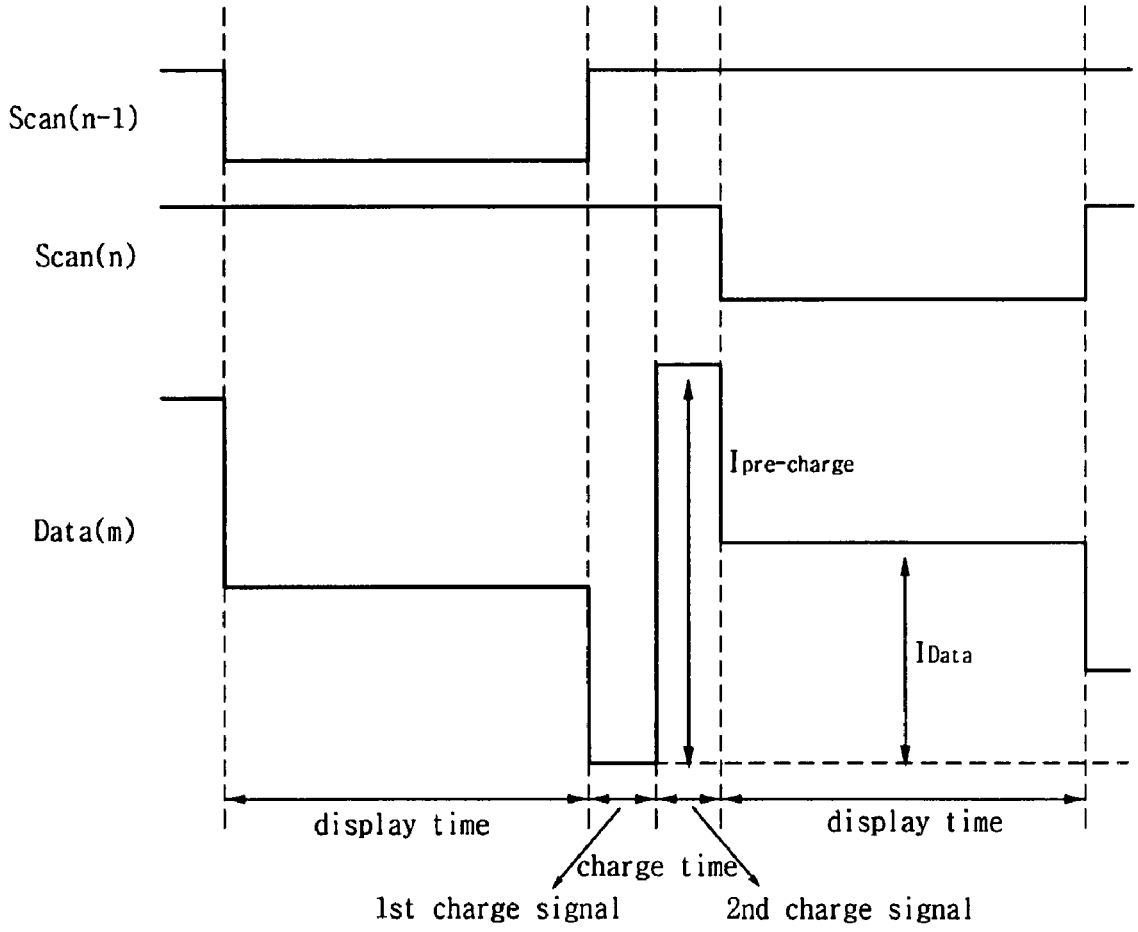
FIG. 3 is a waveform diagram based on driving methods of a flat panel display according to the embodiment of the present invention.
Figure 4:
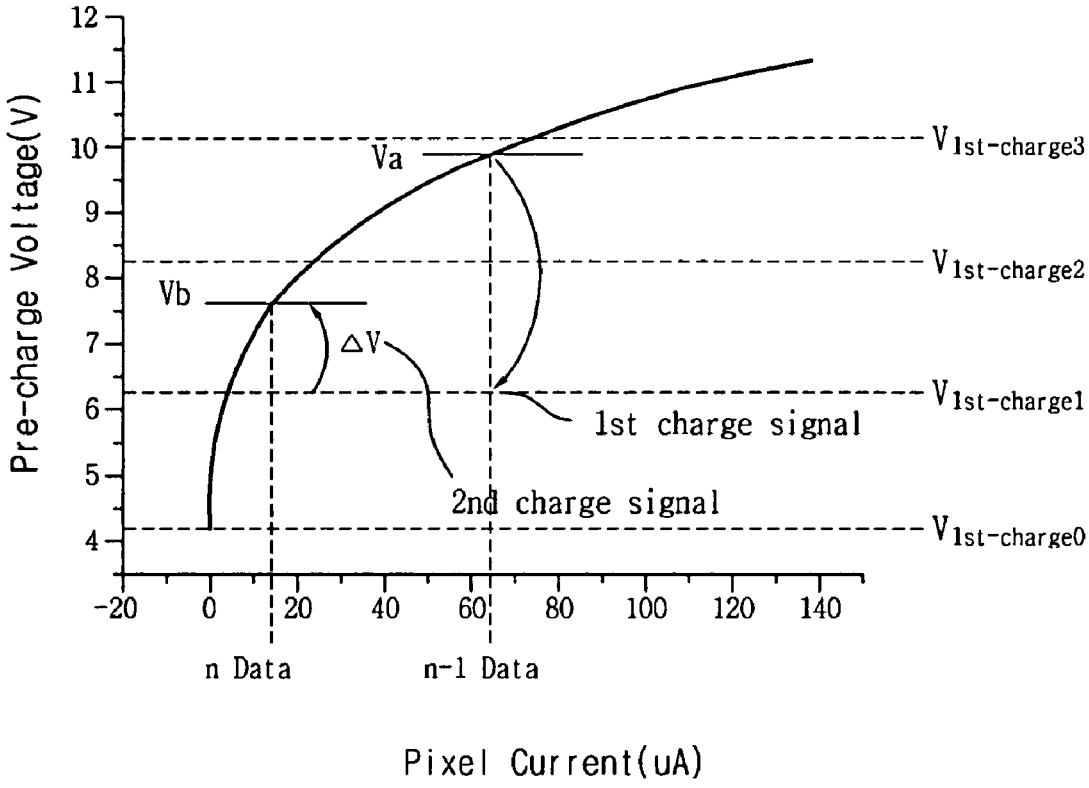
FIGS. 4 and 5 are graphs illustrating the relationship between a pixel current and a pre-charge voltage to describe a driving method of a flat panel display according to the embodiment of the present invention.
Figure 5:
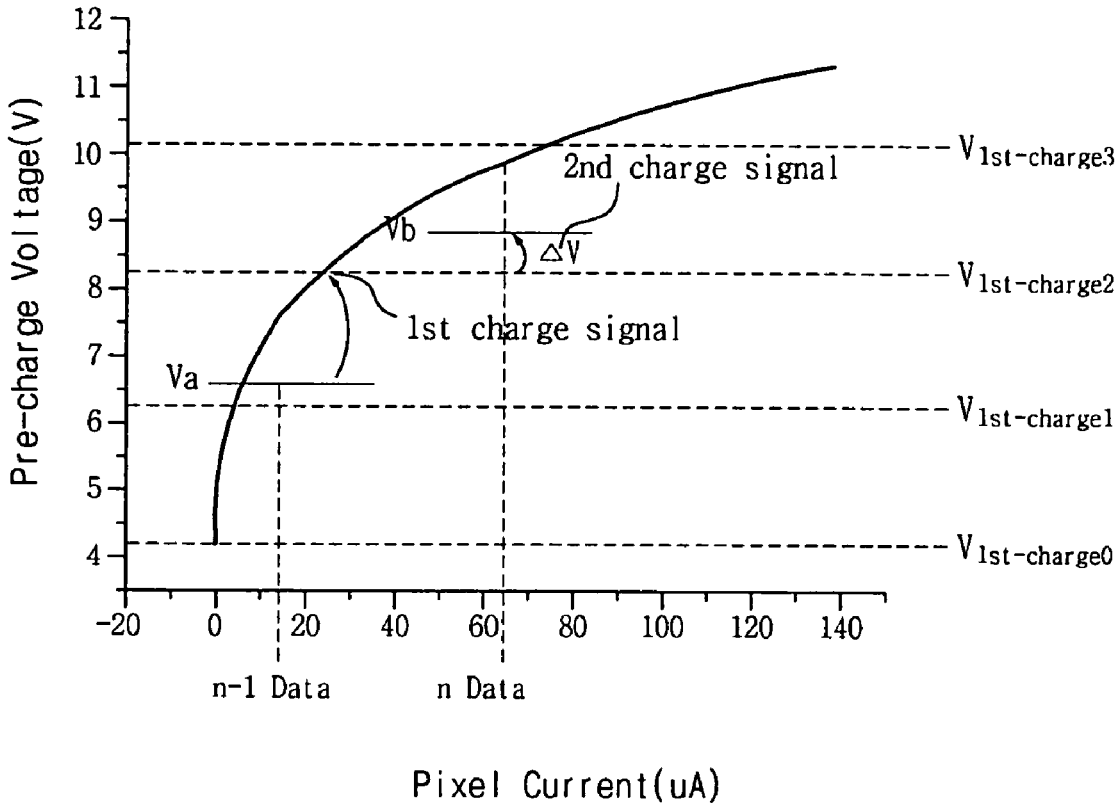

FIG. 3 is a waveform diagram based on driving methods of a flat panel display according to the embodiment of the present invention, and FIGS. 4 and 5 are graphs illustrating the relationship between a pixel current and a pre-charge voltage to describe a driving method of a flat panel display according to the embodiment of the present invention.

For easy understanding, description will be provided with reference to FIGS. 4 and 5 along with an example. Herein, it is assumed that the voltage value set in the first charge output part 154 has four steps, i.e., V 1st_charge0, 1, 2 and 3.

When a control signal is supplied from the controller (not shown) to the driving part 140, the scan driver 145 supplies a scan signal to the pixel part 120 through a scan line 130A. The data output part 151 of the data driver 150 supplies the data signals transmitted from the outside to the data processing part 152, and the data processing part 152 processes the received data signals to thereby generate the first and second charge signals corresponding to the data signals.

To describe the generation of the first and second charge signals more in detail, when data signals are supplied from the data output part 151 to the data processing part 152, the data processing part 152 determines an ideal charge value for the data signals based on the lookup table 153. In FIG. 4, the ideal charge value is Vb. Subsequently, the data processing part 152 selects and outputs a value, which is smaller than the ideal charge value and most close to the ideal charge value in the first charge output part 154. Accordingly, the first charge signal is determined to be V 1st_charge1. The data processing part 152 generates the second charge signal (ΔV) which corresponds to the difference between the ideal charge value and the first charge signal, i.e., Vb and V 1st_charge1. Referring to FIG. 4 herein, the sub-pixels are charged to be Va by the data (n−1 data) supplied to the previous frame. Therefore, when the first and second charge signals are supplied, the pixel part 120 can be discharged to the optimal voltage value.

Referring to FIG. 5, the ideal charge value is B and the first charge signal is V 1st_charge2. Thus, the data processing part 152 generates the second charge signal (ΔV) corresponding to the difference between the ideal charge value and the first charge signal, i.e., Vb and V 1st_charge2. Herein, the pixel part 120 is charged to be Va by the previous data (n−1 data). Therefore, when the first and second charge signals are supplied, the pixel part 120 can be pre-charged to the optimal voltage value.

The data output part 151 outputs the data signals and the second charge signal to the converter 155 and outputs the first charge signal to the switch part 160 through the first charge output part 154.

The converter 155 converts the digital signals, i.e., the data signals and the second charge signal, into analog signals, i.e., current, and outputs it to the switch part 160 based on the control signal of the controller.

When the third switch SW3 is turned on based on the control signal of the controller, the first charge signal is supplied to the pixel part 120 through the first charge output part 154. Herein, the controller can supply the first charge signal to the pixel part 120 by turning on a switch connected to a selected voltage value among the voltage values of the first charge output part 154. Subsequently, when the second switch SW2 is turned on, the second charge signal is supplied to the pixel part 120 and the pixel part 120 is charged with an ideal charge value. When the first switch SW1 is turned on based on the control signal of the controller, data current is supplied to the pixel part 120. Accordingly, the pixel part 120 can display image corresponding thereto.

As described above, the flat panel display suggested in the first embodiment of the present invention can supply the optimal charge value corresponding to the data signal to the pixel part 120. Therefore, power consumption is reduced, and exact image corresponding to the data signals can be represented to thereby improve image quality of a screen.

Figure 6:
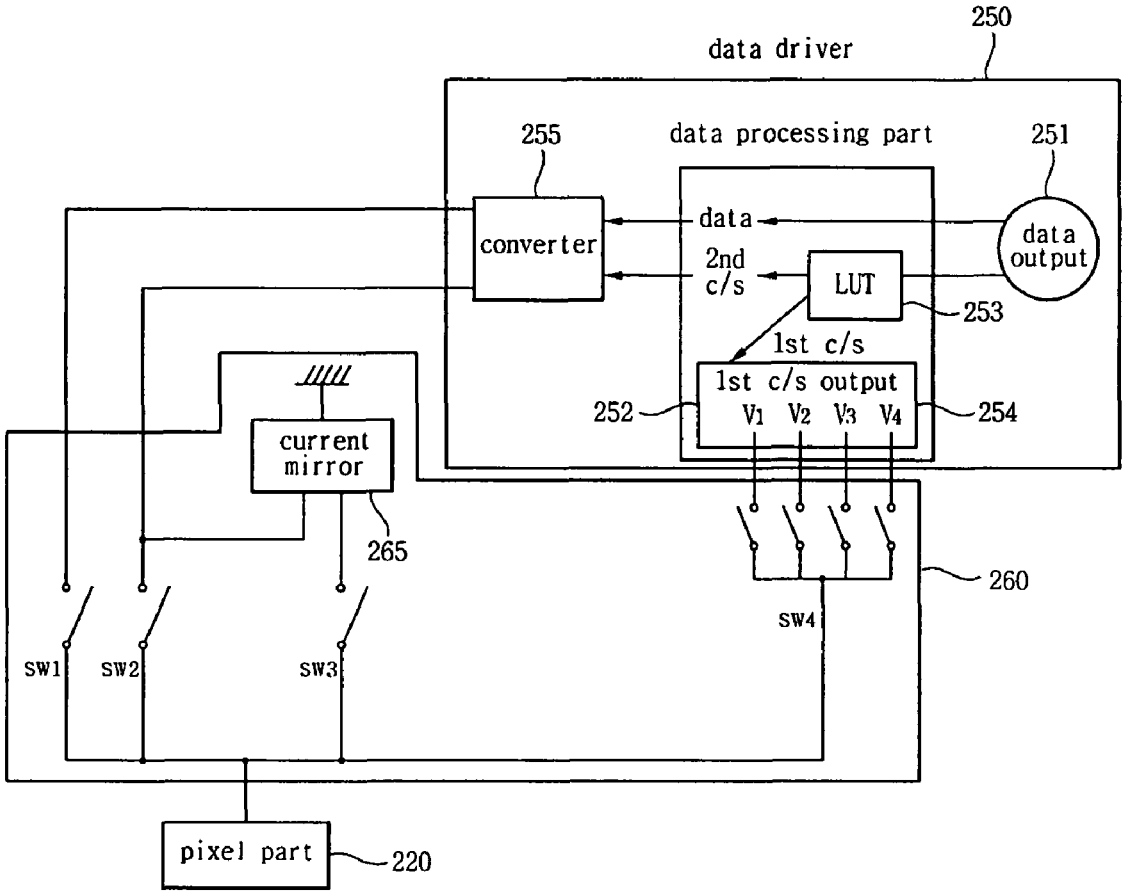
FIG. 6 is a block view describing a data driver of a flat panel display according to another embodiment of the present invention.

FIG. 6 is a block view describing a data driver of a flat panel display according to another embodiment of the present invention.

Referring to FIG. 6, the data driver 250 comprises a data output part 251, a data processing part 252, and a converter 255.

The data output part 251 receives digital data signals from the outside and transmits them to the data processing part 252. The data processing part 252 processes the data signals transmitted from the data output part 251 to thereby generate charge signals. The charge signals comprise a first charge signal and the second charge signal.

The charge signal may be supplied before the data signals are supplied to the pixel part (P). The pre-charge signal can be obtained by processing the data signals and calculating the optimal value.

Herein, the data processing part 252 may comprise the lookup table 253 and a first charge output part 254. The lookup table 253 stores ideal charge values corresponding to the data signals, and the first charge output part 254 comprises a plurality of preset voltage values. The data processing part 252 receives the data signals, determines an ideal charge value for data signals based on the lookup table 153, selects a voltage value which is closest to the ideal voltage value in the first charge output part 254, and outputs a first charge signal. Then, it generates a second charge signal corresponding to the difference between the ideal charge value and the first charge signal.

The converter 255 converts the data signals transmitted from the data processing part 252 or the second charge signal into current. In short, it converts digital signals into analog signals.

The driving part 240 may further comprise a switch part 260. The switch part 260 is connected to a controller (not shown) and the data driver 250 and optionally supplies the data signals, the first charge signal, and the second charge signal to the pixel part 220. The switch part 260 comprises a first switch SW1 and a second switch SW2 between the converter 255 and the pixel part 220. The data signals may be supplied to the pixel part 220 through the first switch SW1, whereas the second charge signal may be supplied to the pixel part 220 through the second switch SW2. The switch part 260 may comprise a current mirror 265 and a third switch SW3 interposed between the current mirror 265 and the pixel part 220. The current mirror 265 is connected to one end of the second switch SW2 and one end of the third switch SW3.

Herein, the third switch SW3 can discharge pixel parts as much as the second charge signal by comprising the current mirror 265 connected to a ground voltage.

The second and third switches SW2 and SW3 may comprise a booster to thereby quickly perform pre-charging or discharging. The switch part 260 may further comprise a fourth switch SW4 interposed between the first charge output part 254 and the pixel part 220. The fourth switch SW4 may comprise a plurality of switches connected to a plurality of voltage values determined in the first charge output part 254.

Figure 7:
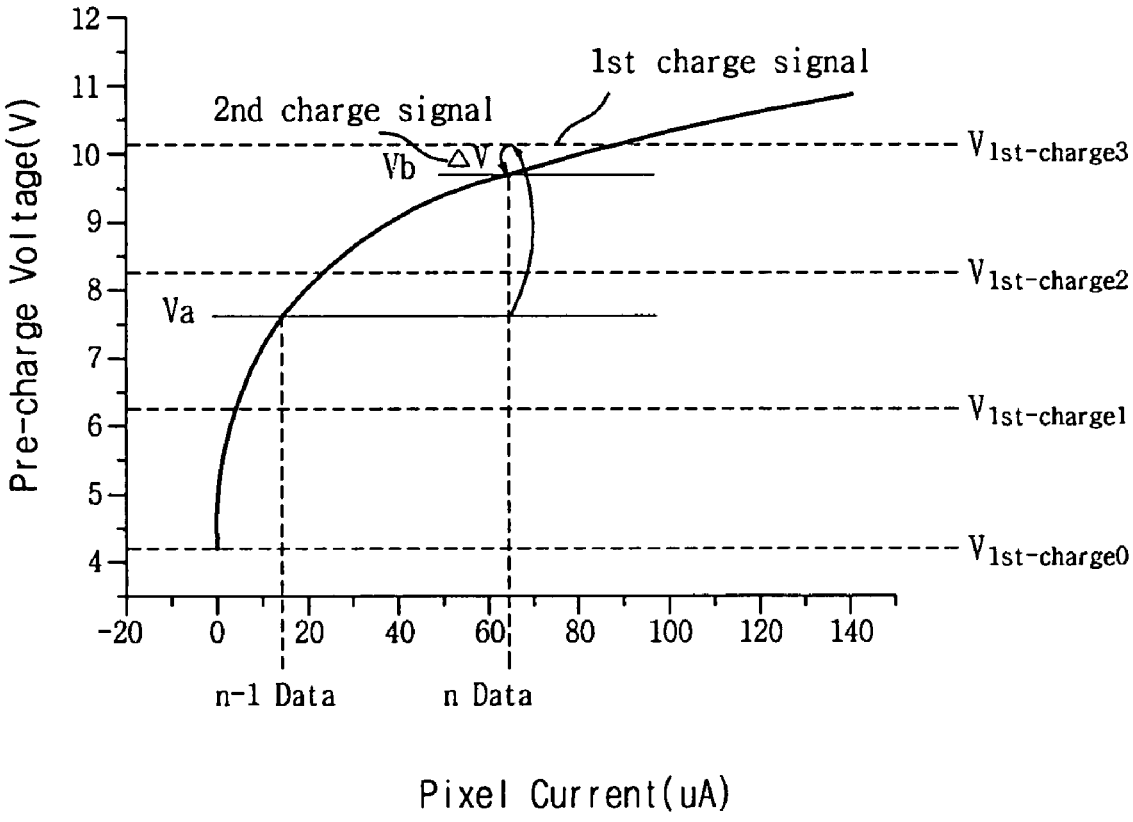
FIG. 7 is a graph illustrating the relationship between a pixel current and a pre-charge voltage to describe a driving method of a flat panel display according to the embodiment of the present invention.

FIG. 7 is a graph illustrating the relationship between a pixel current and a pre-charge voltage to describe a driving method of a flat panel display according to an embodiment of the present invention. The driving method of a flat panel display suggested in the embodiment of the present invention will be described with reference to FIGS. 3, 6 and 7 hereinafter. Herein, it is assumed that the voltage value set in the first charge output part 254 has four steps, i.e., V 1st_charge0, 1, 2 and 3.

When a control signal is supplied from the controller (not shown) to the driving part 240, the scan driver 245 supplies a scan signal to the pixel part 220 through a scan line 230A. The data output part 251 of the data driver 250 supplies the data signals transmitted from the outside to the data processing part 252, and the data processing part 252 processes the received data signals to thereby generate the first and second charge signals corresponding to the data signals.

To describe the generation of the first and second charge signals more in detail, when data signals are supplied from the data output part 251 to the data processing part 252, the data processing part 252 determines an ideal charge value for the data signals based on the lookup table 253. In FIG. 7, the ideal charge value is Vb. Subsequently, the data processing part 252 selects and outputs a value which is smaller than the ideal charge value and closest to the ideal charge value in the first charge output part 254. Accordingly, the first charge signal is determined to be V 1st_charge3. The data processing part 252 generates the second charge signal (ΔV) which corresponds to the difference between the ideal charge value and the first charge signal, i.e., Vb and V 1st_charge3. Referring to FIG. 7 herein, the sub-pixels are charged to be Va by the data (n−1 data) supplied to the previous frame. Therefore, when the first and second charge signals are supplied, the pixel part 220 can be discharged to the optimal voltage value.

The data output part 251 outputs the data signals and the second charge signal to the converter 255 and outputs the first charge signal to the switch part 260 through the first charge output part 254.

The converter 255 converts the digital signals, i.e., the data signals and the second charge signal, into analog signals, i.e., current, and outputs it to the switch part 260 based on the control signal of the controller.

When the fourth switch SW4 is turned on based on the control signal of the controller, the first charge signal is supplied to the pixel part 220 through the first charge output part 254. Herein, the controller can supply the first charge signal to the pixel part 220 by turning on a switch connected to a selected voltage value among the voltage values of the first charge output part 254. Subsequently, when the third switch SW3 is turned on, the second charge signal is supplied to the current mirror 265 and thus the pixel part 220 is discharged as much as an amount corresponding to the second charge signal through the third switch SW3. Herein, since the first charge signal is larger than the ideal charge value, the second charge signal becomes a discharge signal.

When the ideal charge value is larger than the first charge signal, the second charge signal becomes a pre-charge signal. In this case, the second switch SW2 is turned on and current corresponding to the second charge signal is supplied to the pixel part 220.

Subsequently, when the first switch SW1 is turned on based on a control signal of the controller, data current is supplied to the pixel part 220 and the pixel part 220 represents image corresponding to the data current.

As described above, the flat panel display suggested in the second embodiment of the present invention can supply the ideal charge value corresponding to the data signal through the data processing part 252. Therefore, power consumption is reduced, and exact image corresponding to the data signals can be represented to thereby improve image quality of a screen.

What is claimed is:

1. A pre-charging circuit for flat panel display comprising:

a substrate;

a pixel part having a plurality of sub-pixels formed on the substrate; and a data driver supplying to the pixel part data signals and charge signals containing charge values that correspond to the data signals, each charge signal including a first charge signal and a second charge signal, and the first charge signal being a voltage signal selected from a plurality of preset voltage levels, wherein the second charge signal is a current signal corresponding to the difference between the voltage value corresponding to the first charge signal and the charge value that corresponds to the data signal, wherein the data driver comprises a data output part, a data processing part, a converter which converts the data signal and the second charge signal into current values, and a switch part, wherein the switch part comprises a first switch connected between the converter and the pixel part to supply the data signals to the pixel part, a second switch connected between the converter and the pixel part to supply the second charge signals to the pixel part, a third switch connected between the converter and a discharge path to discharge the pixel part, a fourth switch connected between the first charge signal output part and the pixel part to supply the first charge signals to the pixel part, and a current mirror part connected between the converter, the third switch and the discharge path, wherein the data processing part determines the charge value corresponding to the data signal from the data output part and selects the first charge signal from the preset values and generates the second signal corresponding to the difference between the charge value and the first charge signal.

2. The pre-charging circuit of claim 1, wherein the second switch is turned on when the difference between the charge value and the first charge signal is a positive value, the third switch is turned on when the difference between the charge value and the first charge signal is a negative value.

3. The pre-charging circuit of claim 1, wherein the fourth switch comprises a plurality of switches respectively connected to a plurality of the power lines supplying the preset voltages of the first charge signal output part.

4. The flat panel display of claim 1, wherein the sub-pixel comprises an organic light emitting diode comprising a first electrode, a second electrode and an organic light emission layer interposed between two electrodes, wherein the sub-pixel further comprises a transistor and a capacitor electrically connected to the organic light emitting diode.

* * * * *